United States Patent [19]

Smorol et al.

[11] Patent Number: 4,492,092

[45] Date of Patent: Jan. 8, 1985

[54] COMBINATION REFRIGERANT CIRCUIT AND HOT WATER PREHEATER

[75] Inventors: Michael E. Smorol, Syracuse; Michael C. Wituszynski, Liverpool; Theodore L. Woollis, Clay, all of N.Y.

[73] Assignee: Carrier Corporation, Syracuse, N.Y.

[21] Appl. No.: 394,575

[22] Filed: Jul. 2, 1982

[51] Int. Cl.[3] ..... F25D 17/00

[52] U.S. Cl. ..... 62/181; 62/183; 62/238.6; 236/21 B

[58] Field of Search ..... 62/183, 181, 238.6, 62/238.7, 238.1; 236/21 R, 21 B; 237/2 B

[56] References Cited

U.S. PATENT DOCUMENTS

| | | | |
|---|---|---|---|
| 2,042,812 | 6/1936 | Tull et al. | 62/179 |
| 3,922,876 | 12/1975 | Wetherington, Jr. | 62/180 |
| 4,089,667 | 5/1978 | Johsson | 62/238 |
| 4,098,092 | 7/1978 | Singh | 62/238 |
| 4,141,222 | 2/1979 | Ritchie | 62/179 |
| 4,142,379 | 3/1979 | Kuklinski | 62/179 |
| 4,281,519 | 8/1981 | Spath et al. | 62/79 |
| 4,293,093 | 10/1981 | Raymond et al. | 62/238.6 X |

OTHER PUBLICATIONS

Carrier Publication, "Weathermaster III Heat Pump System".

*Primary Examiner*—Harry Tanner
*Attorney, Agent, or Firm*—Robert H. Kelly

[57] ABSTRACT

A combination refrigeration circuit and hot water preheater is disclosed. Specific temperature sensing arrangements in combination with a bypass circuit and a continually operating pump are disclosed to obtain effective control of the hot water preheating system in combination with a refrigeration circuit. Additionally disclosed is an air conditioning system having a combination desuperheater hot water preheater built into a compressor section thereof to eliminate field connections to a hot water preheater.

2 Claims, 4 Drawing Figures

5369

COMBINATION REFRIGERANT CIRCUIT AND HOT WATER PREHEATER

BACKGROUND OF THE INVENTION

1. Field of the Invention

The present invention relates to a device for transferring heat energy from a refrigeration circuit to a hot water system. More particularly, the present invention concerns a combination refrigerant desuperheater hot water heater and a method of integrating same into an air conditioning system.

2. Description of the Prior Art

In a typical vapor compression refrigeration system various components such as a compressor, condenser, evaporator and an expansion device are arranged to transfer heat energy between fluid in heat exchange relation with the evaporator and fluid in heat exchange relation with the condenser. It is also known in conjunction with such refrigeration systems to utilize desuperheaters for removing superheat energy from the gaseous refrigerant prior to circulating said refrigerant to the condenser.

In a conventional building installation a hot water heater is provided to supply heated water to an enclosure. Many hot water heaters have a cold water inlet connected to an inlet extension pipe and a hot water outlet extending through the top of the hot water tank. It is known to make the appropriate water connections between a hot water heater and a refrigeration circuit desuperheater such that water is conducted from the water supply system to the refrigerant desuperheater where it is preheated prior to being conducted back to the hot water tank. In air conditioning systems when cooling is required, heat energy is transferred from the enclosure and discharged to the ambient or some other heat sink. This heat energy is often wasted. With the combination system as disclosed herein it can be seen that this heat energy that is unwanted in the enclosure may be utilized to supply heat energy to water to provide heated water for various end uses. This heated water may be used for bathing, cleaning, cooking or other uses in a residence. Commercial applications include restaurants, supermarkets, process utilization and any other application wherein waste energy or excess energy from a refrigeration system may be utilized to provide some or all of the hot water heating needs.

In addition to refrigeration systems providing excess heat for heating water during the cooling system, certain refrigeration circuits are capable of reversing the cycle of operation for providing heat energy to the enclosure during the heating season. This type of refrigeration circuit is commonly referred to as a heat pump. If it is desirable, some of the heat energy provided during the heating season with the heat pump may also be utilized to supply hot water through the disclosed hot water heater refrigerant desuperheater.

In the specific embodiment disclosed an air conditioning system commonly known as a triple split system, is utilized to provide a combination operation. A triple split system as utilized herein will include a refrigeration circuit having three separate sections, an outdoor section including an outdoor heat exchanger mounted in heat exchange relation with the ambient air, an indoor section mounted in heat exchange relation with the heat transfer fluid being circulated throughout the enclosure for effecting heating or cooling, and a compressor section including the compressor of the refrigeration circuit and the combination refrigerant desuperheater hot water heater.

The control of the water flow through the combination desuperheater hot water heater is specifically arranged to allow for efficient and safe operation of the system. As disclosed, a pump is operated continuously when the compressor of the refrigeration circuit is operated such that water is continually circulated from the water connecting system to the heat exchanger. A bypass line is located in a parallel flow path with the combination desuperheater hot water heater. The bypass line includes a restricted orifice for limiting the volume of water flow through the bypass line. An entering water temperature sensing device is located to sense the temperature of the water entering the unit. A leaving water temperature sensing device is located to sense the temperature of the water leaving the combination desuperheater hot water preheater. A valve is located to control the flow of water through the combination desuperheater hot water heater and a safety sensor is located to determine the temperature of the water being discharged back to the hot water heating system. The pump operating in conjunction with the compressor acts to circulate water through the combination desuperheater hot water preheater when the incoming water temperature is below the desired water temperature and when the leaving water temperature is above the temperature to which it is desired to heat the water.

The safety sensor serves to de-energize the complete control circuit including the compressor of the refrigeration circuit to prevent water flow from the combination desuperheater hot water heater should the water temperature rise above a safe level for delivery of water within the residence. All of the temperature sensors are connected in series to the water valve to form an integrated control arrangement for regulating the flow of water through the combination desuperheater preheater. The utilization of the restricted flow bypass allows for a continual amount of water circulation such that accurate temperature readings may be maintained.

The addition of the safety temperature sensor for controlling the water valve in the system allows potential hot water overheating problems to be avoided should either of the primary control components fail. In a residence it is possible to open a hot water tap and to get a short blast of extremely hot water directly from the preheater. By providing this safety device water above an excessive temperature is not allowed to enter the water tank or the return line to the hot water heating system and hence potential problems are avoided.

SUMMARY OF THE INVENTION

It is an object of the present invention to provide a combination hot water heater and refrigerant desuperheater having a control arrangement for integrating the control of the flow of water therethrough.

It is a further object of the present invention to provide an apparatus for controlling a water valve regulating the flow of water through a combination desuperheater hot water heater.

Another object of the present invention is to provide a multi-component refrigeration system including a compressor section incorporating a compressor and refrigerant desuperheater hot water heat exchanger within a single section, said section being separate from the indoor and outdoor heat exchangers.

A further object of the present invention is to provide a safe, economical and reliable system for taking maximum advantage of the heat energy contained in the refrigerant of the refrigeration circuit for effecting hot water heating.

These and other objects are achieved according to a preferred embodiment of the invention wherein there is disclosed a combination refrigeration circuit including a compressor and a hot water heating system. A water inlet for receiving water to be heated, a water outlet for discharging water and a pump connected to receive water from the water inlet to circulate water through the water heating system are disclosed. This pump is energized in conjunction with the compressor of the refrigeration circuit. Heat exchange means are connected to receive hot gaseous refrigerant from the refrigerant circuit and to effect a transfer of heat energy from said refrigerant to the water flowing through the water heating system. A first water conduit means connects the heat exchange means to the pump. A valve means is located to control the flow of water from the heat exchange means to the water outlet and a second water conduit means connects the heat exchange means to a valve means. A third water conduit means connects the valve means to the water outlet and bypass means including a flow restriction for limiting flow therethrough connects the first conduit to the third conduit means. A safety temperature sensor for sensing the temperature of water flowing to the water outlet through the third conduit means including water flowing through the bypass means is located and connected via circuit means to the valve means for shutting down the unit completely as well as closing the valve to prevent the flow of water through the heat exchanger when the temperature of the water being circulated in heat exchange relation with the safety temperature sensor exceeds a threshhold temperature. The apparatus may further include an entering water temperature sensor for sensing the temperature of the water flowing through the water inlet, a leaving water temperature sensor for sensing the temperature of water flowing through the second conduit means and a circuit means including a water valve being connected with the safety sensor, the entering water temperature sensor and the leaving water temperature sensor such that the valve is open permitting water flow only when all three temperature sensors detect appropriate water temperatures.

A compact combination air conditioning and hot water heating system is additionally disclosed for use in residential application having a primary hot water heating system including hot and cold water lines and means for conducting a heat transfer fluid about the residence. An outdoor section designed to be located exterior of the space to be conditioned includes an outdoor heat exchanger of the refrigeration circuit and fan means for circulating air in heat exchange relation with the refrigerant flowing through the outdoor heat exchanger. An indoor section connected to the means for conducting heat transfer fluid about the residence includes an indoor heat exchanger of the refrigeration circuit being located such that the heat transfer fluid is circulated in heat exchange relation with the refrigerant flowing through the indoor heat exchanger. The compressor section includes a compressor forming a portion of the refrigeration circuit and a combination refrigerant desuperheater hot water preheater connected to receive hot gaseous refrigerant from the compressor for transferring heat energy to the water flowing therethrough. Refrigerant conduits connect the compressor in combination with the desuperheater preheater of the compressor section to the heat exchanger of the indoor section and to the heat exchanger of the outdoor section. An additional refrigerant conduit connects the heat exchanger in the outdoor section directly to the heat exchanger of the indoor section. A water conduit connects the combination desuperheater preheater of the compressor section to the hot and cold water lines to the primary hot water heating system whereby water for the hot water heating system is preheated within the compressor section.

DESCRIPTION OF THE PREFERRED EMBODIMENT

The embodiment of the control for the utilization of the combination hot water heater desuperheater as disclosed herein is utilized in conjunction with a triple split air conditioning system. It is to be understood that the control of a refrigerant desuperheater hot water preheater may be used in other applications and is not limited to this specific structural combination.

Figure 1:
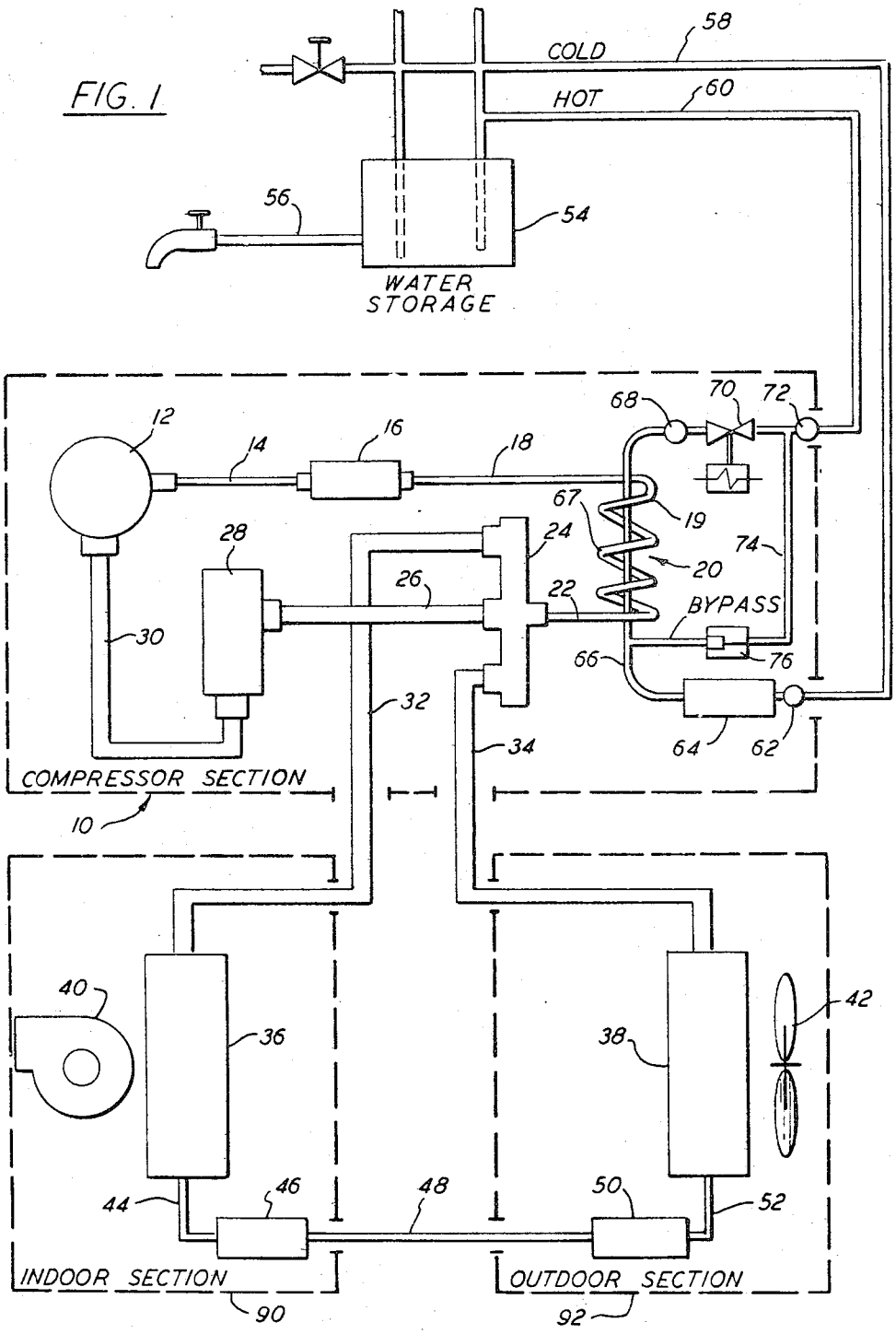
FIG. 1 is a schematic representation of an air conditioning hot water heating system.

Referring first to FIG. 1, there may be seen a combination hot water heating and air conditioning system. This figure is a schematic representation of the integration of the two systems. The air conditioning system includes a compressor section 10, indoor section 90 and outdoor section 92. The hot water heating system includes a water storage tank 54, outlet line 56 and hot and cold water lines 58 and 60. It is through these hot and cold water lines 58 and 60 that the water heating portion of the compressor section 10 is connected.

The refrigeration circuit includes a compressor 12, connecting line 14, muffler 16, connecting line 18, combination desuperheater hot water preheater 20 including refrigerant carrying loop 19, connecting line 22, reversing valve 24, connecting line 26, accumulator 28 and compressor suction line 30. Connected to reversing valve 24 is refrigerant conduit 32 also connected to indoor coil 36. Indoor coil 36 is connected by conduit 44, to expansion device 46, conduit 48, expansion device 50, conduit 52, and to outdoor coil 38. Outdoor coil 38 is connected by conduit 34 to the reversing valve. These various items form a refrigeration circuit such that heat energy is transferred between indoor heat exchanger 36 and outdoor heat exchanger 38. The water circuit, as disclosed, includes a water storage tank 54, cold water line 58, entering water temperature sensor 62, pump 64, conduit 66, the water bearing portion 67 of the combination desuperheater hot water preheater 20, leaving water temperature sensor 68, water valve 70 and safety switch 72. Bypass 74 is provided with a restriction device 76 connecting conduit 66 to conduit 70.

It is noted in FIG. 1 that the compressor section includes the compressor, accumulator, muffler, reversing valve and the various components of the hot water preheating system. The indoor section 90 includes indoor heat exchanger 36 and fan 40. Outdoor section 92 includes outdoor heat exchanger 38 and outdoor fan 42.

Figure 2:
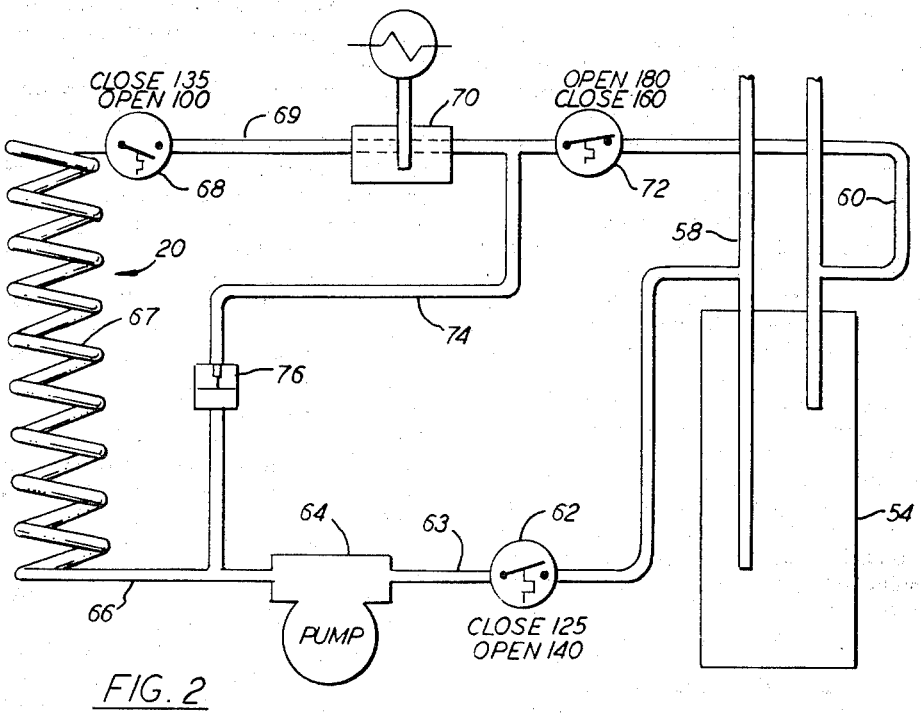
FIG. 2 is a schematic representation of the hot water heating system including the combination desuperheater hot water heater.

Referring more specifically to FIG. 2, which is another schematic view of the hot water heating system, there may be seen a closed water loop. Cold water line 58 is connected such that water inlet 63 has thermal switching device 62 in heat exchange relation therewith. Connected to water inlet 63 is pump 64 for circulating water between the hot water storage tank 54 and the combination desuperheater preheater 20. First conduit means 66 is connected to pump 64 and to combination hot water heater desuperheater 20. The water carrying loop thereof, loop 67, is connected both to conduit 66 and to second conduit 69. Second conduit 69 is connected to water valve 70 and has in heat exchange relation therewith leaving water temperature sensor 68. Bypass conduit 74 connects first conduit 66 with third conduit 60. A restriction 76 having a very narrow orifice for restricting water flow therethrough is mounted within bypass line 74. Safety sensor 72 is located in heat exchange relation with conduit 60 for detecting the temperature of water flowing therethrough.

As indicated in FIG. 2, entering water temperature sensor 62 is designed to close forming an electrical connection when the temperature sensed drops to 125° F. or below and to open when it reaches a temperature of 140° F. or above. Leaving water temperature sensor 68 is designed to close when the water temperature reaches 135° F. and open when the water temperature drops to 100° F. Water temperature safety sensor 72 is designed to open when the water temperature rises to a temperature of 180° F. and to close when the water temperature falls to a temperature of 160° F.

Figure 3:
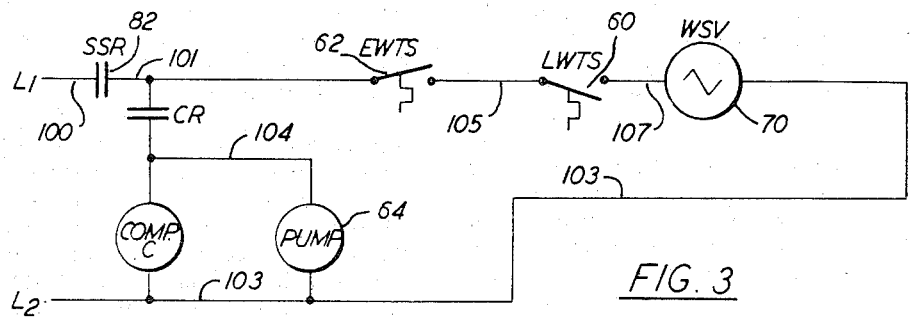
FIG. 3 is a partial wiring schematic showing the utilization of the various thermal sensing devices of the control for the water portion of the hot water heating system.

Referring now to FIG. 3, there may be specifically seen the integration and the operation of the hot water heating system with the air conditioning system. Lines L-1 and L-2 are indicated in FIG. 3 to be the control circuit power source. Connecting line L-1 to normally open safety sensor relay contacts 82 is wire 100. Wire 101 connects contacts 82 to the compressor relay contacts CR and to entering water temperature thermostat 62. Wire 104 connects contacts CR to the compressor contactor and to pump 64. Wire 103 connects line L-2 to the compressor contactor, to pump 64 and to water solenoid valve 70. Entering water temperature thermostat 62 is connected via wire 105 to leaving water temperature sensor 68 which is connected via wire 107 to water solenoid valve 70.

Figure 4:
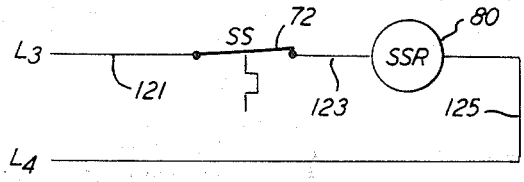
FIG. 4 is a partial wiring schematic of a safety switch and safety switch relay portion forming a part of the control circuit.

In FIG. 4 it may be seen that connected in series between lines L-3 and L-4 are wire 121, safety switch 72, wire 123, safety switch relay 80 and wire 125.

OPERATION

When the compressor of the air conditioning system is energized to provide heating or cooling to the enclosure the compressor relay closes contact CR and safety switch relay contacts SSR close supplying power to compressor contactor for energizing the compressor and supplying power to the pump 64. In this condition pump 64 acts to circulate water from either the storage tank 54 or cold water line 58 through the hot water preheating system and back to storage tank 54. The pump is operated continuously during times the compressor is operated and acts to circulate water through the combination desuperheater hot water heater and/or to provide a minor flow of water through bypass conduit 74 and restriction 76. This continual minor flow of water allows the temperature of the water in the tank to be continually monitored at entering water thermostat 62.

The water solenoid valve 70 is normally closed. The water solenoid valve 70 is only opened at such times when all three temperature sensors, the entering water temperature sensor, the leaving water temperature and the safety sensor are closed by sensing the appropriate temperature conditions. Hence, should the entering water temperature be below 140° F. indicating that additional heating is needed and should the leaving water temperature sensor be closed since the leaving water temperature from the combination desuperheater hot water heater is above 135° F. indicating that the water has been sufficiently heated and should the safety sensor, which is normally closed, detect a temperature less than 180° F. indicating that the water has not been excessively heated then, in such event, the water solenoid valve is opened and water is circulated through the combination desuperheater and preheater back to storage tank 54. Should the entering water temperature sensor detect water above 140° F. then the sensor is opened and there is no water flow through the combination desuperheater hot water preheater. Should the leaving water temperature thermostat detect a temperature less than 135° F. then the sensor will not close and the valve will remain closed. Once the temperature reaches 135° F. the valve will be opened until such time as the water temperature drops to 100° F. at which time the leaving water temperature sensor is opening thereby closing the water valve. The entering water temperature thermostat additionally is designed to sense the water temperature and open once the water temperature is above 140° F. The sensor is further designed to delay until the incoming water temperature drops to 125° F. before closing.

The safety switch which is mounted to detect the temperature of the water being circulated back to the storage tank is designed to open at 180° F. and to close at 160° F. Hence, should the water being discharged from the system exceed 180° F. the safety temperature sensor will open de-energizing the unit including the compressor and the pump and the water solenoid valve closing the valve. This safety sensor will remain open until the temperature drops back to 160° F.

The system has been described utilizing a combination control system for a hot water preheater transferring heat energy from a refrigeration circuit. It is to be understood that this particular arrangement for a combination hot water heater refrigerant desuperheater may be utilized with other specific applications. Also, as disclosed herein, there is a combination and physical arrangement of components to utilize a compressor and hot water heating heat exchanger within a single compressor section separated from the indoor and outdoor sections of the air conditioning system. A separate arrangement allows for reduced installation cost, reduced refrigerant connections and for ease of maintenance. By incorporating the refrigerant desuperheater in a single compressor section the refrigerant connections to the desuperheater are made at the factory. Previous combination refrigerant desuperheater hot water preheater devices were sold as separate components and were, of necessity, incorporated in the field with refrigerant connections and water connections made thereto in the field.

A preferred embodiment of the invention has been described but it is to be understood by those skilled in the art that modifications and variations can be effected within the spirit and scope of this invention.

What is claimed is:

1. A combination referigeration circuit including a compressor and a hot water heating system which comprises:

a water inlet for receiving water to be heated;

a water outlet for discharging water to a storage tank and a hot water tap through a single conduit;

a pump connected to receive water from the water inlet and to circulate water through the water heating system to the water outlet, said pump being energized in conjunction with the compressor;

heat exchange means connected to receive hot gaseous refrigerant from the refrigeration circuit and to effect a transfer of heat energy from said refrigerant to the water flowing through the hot water heating system;

a first water conduit means connecting the heat exchange means to the pump;

valve means located downstream of said heat exchange means to control the flow of water from the heat exchange means to the water outlet;

a second water conduit means connecting the heat exchange means to the valve means;

a third water conduit means connecting the valve means to the water outlet;

a bypass means including a flow restriction for limiting flow therethrough connecting the first conduit means to the third conduit means;

an entering water temperature sensor located upstream of said pump;

a leaving water temperature sensor located within said second water conduit means;

a safety temperature sensor located downstream of said bypass means within said third conduit means for sensing the temperature of the water flowing to the water outlet through the third conduit means including water flowing through the bypass means; and circuit means connecting contacts of the safety temperature sensor, said entering water temperature sensor, and said leaving water temperature sensor in series with the valve means, and said contacts of said safety temperature sensor in series with said pump and compressor, which are in parallel, whereby said valve means is open only when said contacts of all three of said safety temperature sensor, said entering water temperature sensor, and said leaving water temperature sensor are closed by sensing the appropriate temperature conditions, and said compressor and said pump are running when only said contacts of said safety temperature sensor are closed.

2. The apparatus as set forth in claim 1 wherein the entering water temperature sensor is a thermal sensing device designed to open above 140° F., to close below 125° F. and wherein the leaving water temperature sensor is a thermal sensing device designed to open below 100° F. and to close above 135° F. such that if the water entering the heating system is already sufficiently heated the valve will remain closed and if the water flowing from the heat exchanger is not sufficiently heated the valve will remain closed and wherein the safety sensor is a thermal sensing device designed to open above 180° F. and to close below 160° F. such that water above this 180° F. temperature is not allowed to enter the storage tank of the hot water tap.

* * * * *